US005949332A

United States Patent [19]

Kim

[11] Patent Number: 5,949,332

[45] Date of Patent: Sep. 7, 1999

[54] FIRE ALARM RADIO TRANSMITTER AND RECEIVER SET

[75] Inventor: Jae-Hoon Kim, 19/9, 107, Dangsan-dong 2ga, Youngdeungpo-ku, Seoul, 150-042, Rep. of Korea

[73] Assignee: Jae-Hoon Kim, Seoul, Rep. of Korea

[21] Appl. No.: 09/116,218

[22] Filed: Jul. 16, 1998

[30] Foreign Application Priority Data

Apr. 21, 1998 [KR] Rep. of Korea ..... 98-14249

[51] Int. Cl.[6] ..... G08B 1/08

[52] U.S. Cl. ..... 340/539; 340/287; 340/577; 340/588

[58] Field of Search ..... 340/521, 531, 340/539, 551, 554, 577, 588, 287, 288, 289, 573.1, 573.4; 370/38, 40, 45

[56] References Cited

U.S. PATENT DOCUMENTS

| | | | |
|---|---|---|---|
| 4,803,469 | 2/1989 | Matsushita | 340/577 |
| 5,166,664 | 11/1992 | Fish | 340/539 |
| 5,272,465 | 12/1993 | Meeres, Jr. | 340/539 |
| 5,283,549 | 2/1994 | Mehaffey et al. | 340/521 |
| 5,381,136 | 1/1995 | Powers et al. | 340/539 |
| 5,382,943 | 1/1995 | Tanaka | 340/539 |
| 5,461,365 | 10/1995 | Schlager et al. | 340/539 |
| 5,500,639 | 3/1996 | Walley et al. | 340/539 |
| 5,543,778 | 8/1996 | Stouffer | 340/531 |
| 5,595,342 | 1/1997 | McNair et al. | 340/539 |
| 5,650,770 | 7/1997 | Schlager et al. | 340/539 |
| 5,686,885 | 11/1997 | Bergman | 340/514 |

*Primary Examiner*—Jeffery A. Hofsass
*Assistant Examiner*—Van T. Trieu
*Attorney, Agent, or Firm*—Birch, Stewart, Kolasch & Birch, LLP.

[57] ABSTRACT

A fire alarm radio transmitter and receiver set is provided with a radio transmitter and a radio receiver. The radio transmitter has a plurality of temperature sensors, a first memory keeping data including an address of a building, a first controller for generating transmission data by combining the data and an identification code and for allowing an alarm to emit an alarm signal, a frequency generator for generating a frequency radio signal and for mixing the frequency radio signal with the transmission data and a transmitter for transmitting the transmission data. The radio receiver has a receiver for filtering the transmission data to detect desired data and for reading the identification code contained in the desired data and for comparing the identification code with registered codes, a display device for displaying the desired data on a screen, a second memory in which the desired data are stored, a notice alarm for emitting an alarm signal, and a second controller which allows the display device to display the desired data and saves the desired data in the second memory and activates the notice alarm, when the identification code contained in the desired data agrees with one of the registered codes.

4 Claims, 4 Drawing Sheets

FIRE ALARM RADIO TRANSMITTER AND RECEIVER SET

FIELD OF THE INVENTION

The present invention relates to a fire alarm radio transmitter and receiver set and a method for controlling the set; and, more particularly, to a fire alarm radio transmitter and receiver set including a radio transmitter for automatically and promptly transmitting an alarm radio signal containing an information about a location and an environment of fire and a radio receiver for receiving the alarm radio signal, being located in a fire fighting public office, e.g., a fire station, to thereby enable a quick extinguishment by fire fighting personnel, and a method for controlling the radio set.

DESCRIPTION OF THE BACKGROUND ART

Generally, there is equipped with a fire alarm system for detecting and alarming fire in large buildings, buildings for a commercial or business use and general structures for a residential use. As shown in FIG. 4, the fire alarm system includes a fire alarm 30 connected to a power supply 32 through a switch 31 which is operated by a control signal from a temperature sensor 33 mounted on predetermined places within those buildings. That is, when the temperature sensor 33 detects an exceeding level of temperature from its surroundings, the switch 31 is turned to an on-state, allowing the power supply 32 to supply the power to the fire alarm 30. As a result, an audible or visual alarm is emitted by the fire alarm 30 to inform people within the buildings of an occurrence of fire.

The background art fire alarm system described above, however, has shortcoming in that the system cannot deliver information about a location of a fire occurrence, e.g., an address or telephone number of the building suffering from a fire to fire fighting personnel or a fire station in a prompt manner, thereby making it difficult to promptly get the fire under control, since the system is constructed to notify only residents within the building of the emergency situation. This is understood from the following situation. When a fire breaks out in a building, reporting the fire emergency situation to a fireman is normally made in such a manner that a person within the building makes a phonecall to a fire station. At the moment, the reporter is usually requested for giving detail information about an address of the building, a self-introduction of the reporter, truth or falsehood on the report, etc., resulting in the fireman arriving at the building suffering from the fire after a prolonged time period, thereby losing a chance to make a quick extinguishment in an early stage of the fire development.

Furthermore, in the event that there's no man in a building, e.g., at night, the fire report to the fire station is significantly delayed, resulting in serious damage from the fire.

SUMMARY OF THE INVENTION

It is, therefore, a primary object of the invention to provide a fire alarm radio transmitter and receiver set including a radio transmitter for automatically and promptly transmitting an alarm radio signal containing information about an address of a building suffering from fire and an identification code and a radio receiver for receiving the alarm radio signal, the radio receiver displaying the received data to inform of the building address and emitting a fire alarm only when the received data includes the identification code, the radio receiver located in a fire fighting public office, e.g., a fire station, to thereby enable a quick extinguishment by fire fighting personnel, and a method for controlling the radio set.

The above and other objects of the invention are accomplished by providing a fire alarm radio transmitter and receiver set provided with a radio transmitter and a radio receiver. In accordance with the present invention, the radio transmitter has a plurality of temperature sensors, a first memory keeping data including an address of a building, a first controller for generating transmission data by combining the data and an identification code and for allowing an alarm to emit an alarm signal, a frequency generator for generating a frequency radio signal and for mixing the frequency radio signal with the transmission data and a transmitter for transmitting the transmission data. Further, the radio receiver has a receiver for filtering the transmission data to detect desired data and for reading the identification code contained in the desire data and for comparing the identification code with registered codes, a display device for displaying the desired data on a screen, a second memory in which the desired data are stored, a notice alarm for emitting an alarm signal, and a second controller which allows the display device to display the desired data and saves the desired data in the second memory and activates the notice alarm, when the identification code contained in the desired data agrees with one of the registered codes.

BRIEF DESCRIPTION OF THE DRAWINGS

The above and other objects and features of the instant invention will become apparent from the following description of preferred embodiments taken in conjunction with the accompanying drawings, in which.

DETAILED DESCRIPTION OF THE PREFERRED EMBODIMENTS

Figure 1:
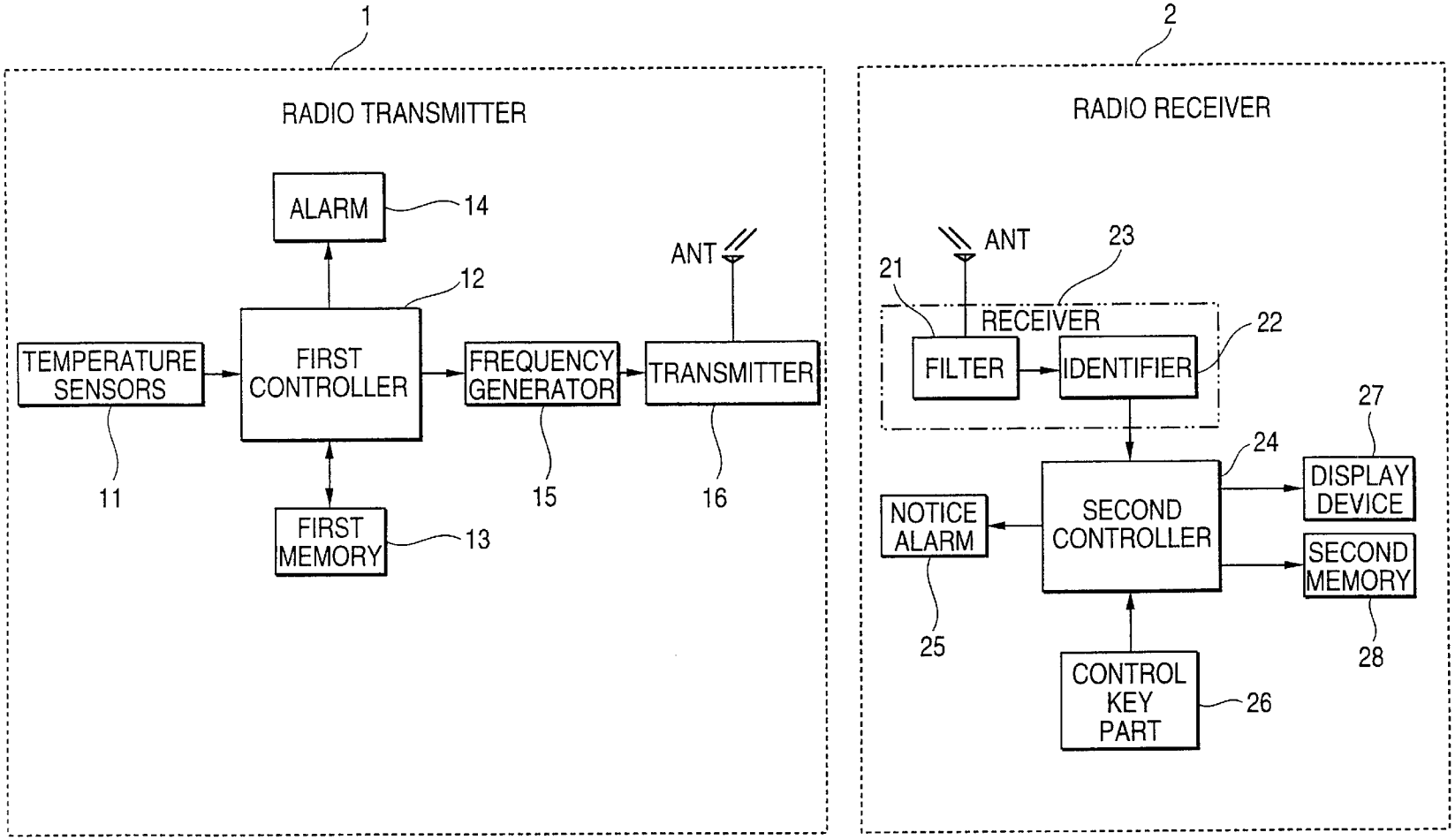
FIG. 1 illustrates a block diagram of a fire alarm transmitter and receiver set in accordance with the present invention.
Figure 2:
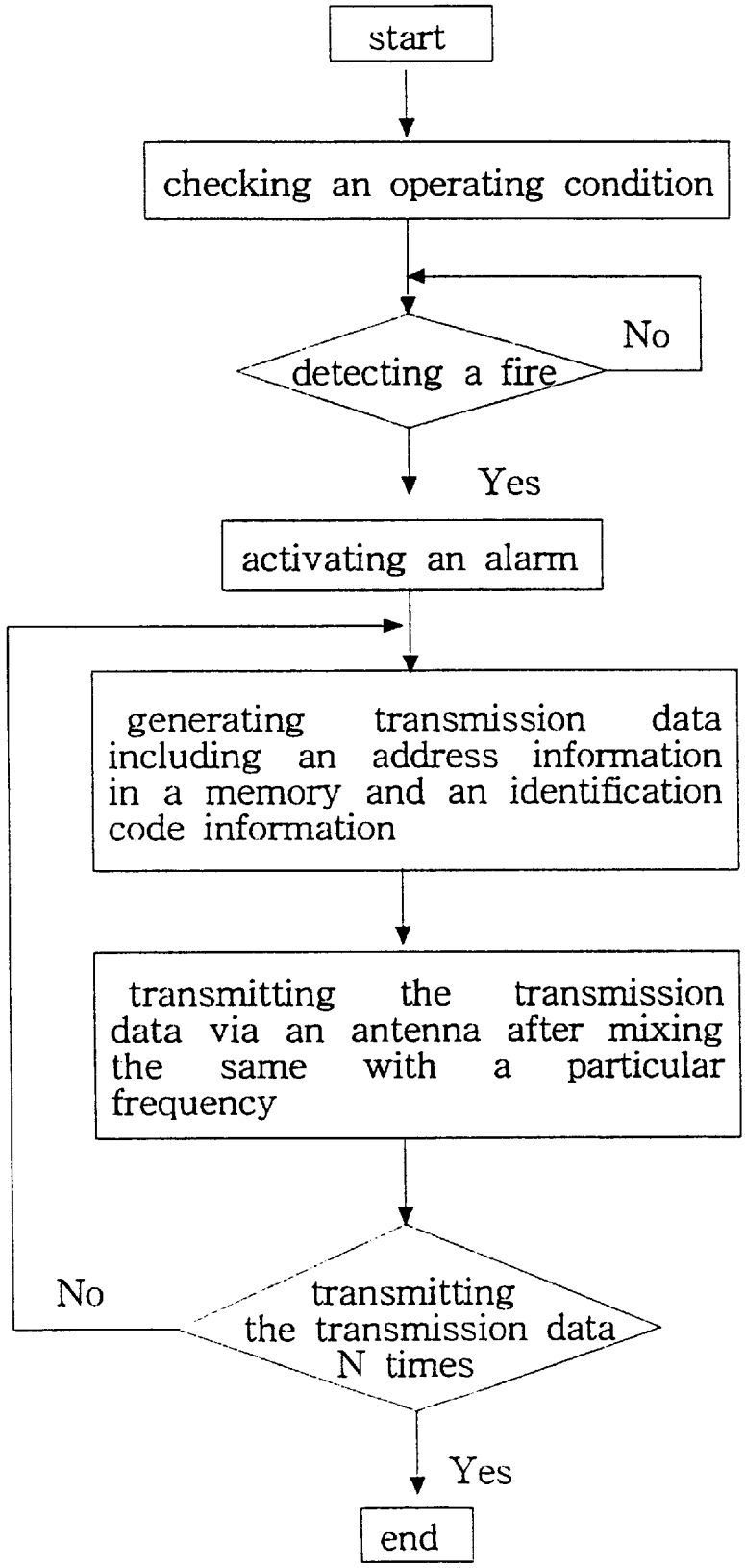
FIG. 2 offers a flow chart showing a control of the radio transmitting process in the present invention.
Figure 3:
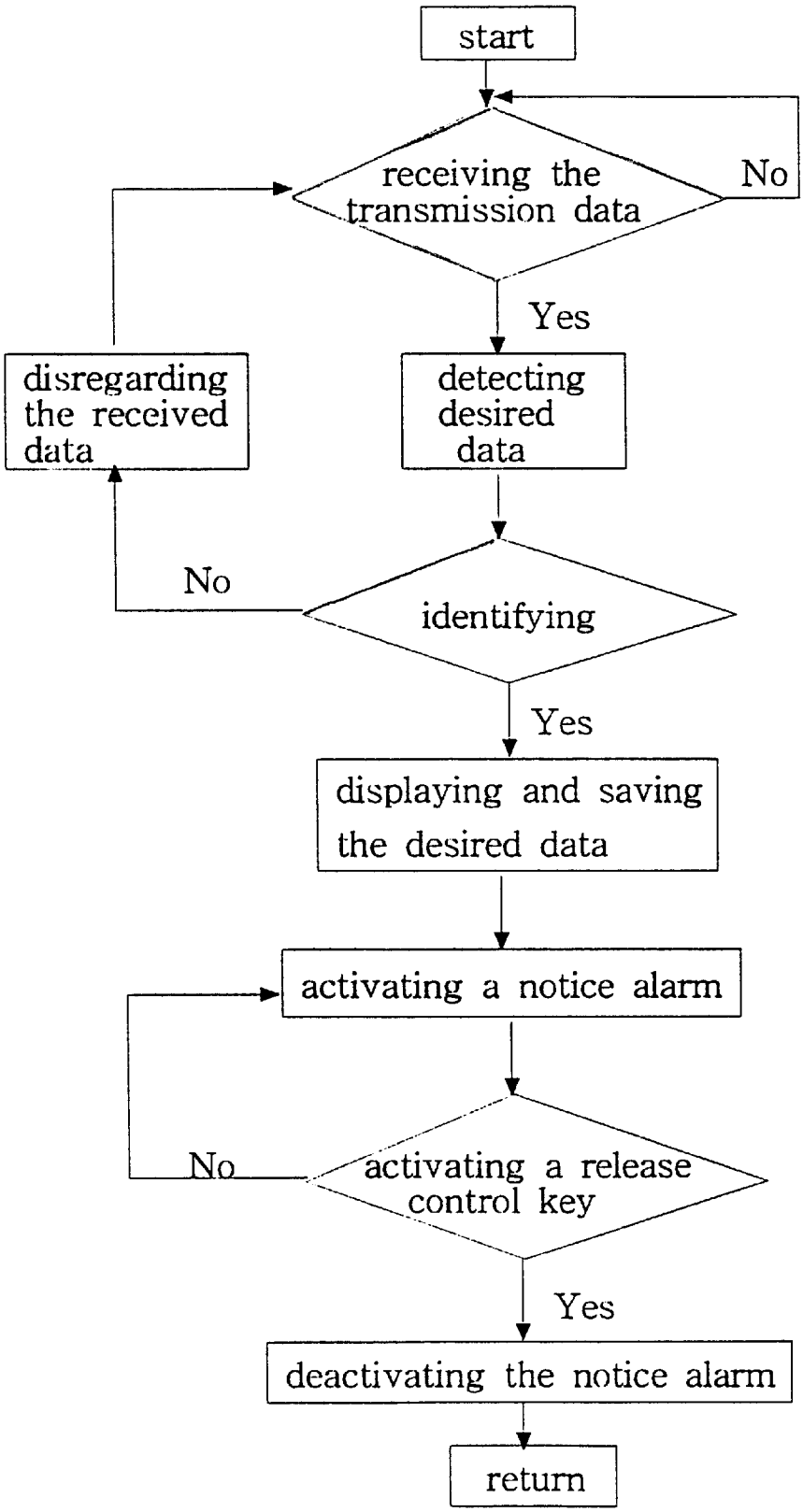
FIG. 3 depicts a flow chart showing a control of the radio receiving process in the present invention.
Figure 4:
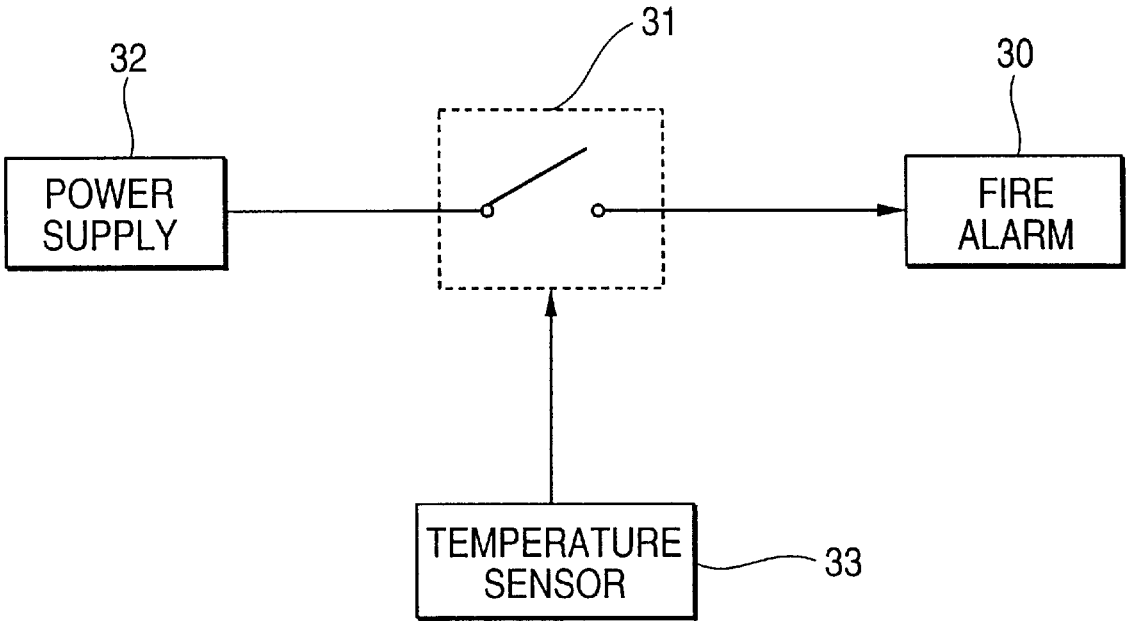
FIG. 4 (BACKGROUND ART)
FIG. 4 shows a block diagram of the background art fire alarm system.

A preferred embodiment of an inventive fire alarm radio transmitter and receiver set is now described with reference to FIGS. 1 to 3.

The present invention is largely divided into a radio transmitter 1 and a radio receiver 2. The radio transmitter 1 is mounted in a building. The radio transmitter 1 includes a plurality of temperature sensors 11 for detecting a temperature of surroundings, a first controller 12 receiving output signals from the temperature sensors 11 and an alarm 14 for emitting a predetermined audio alerting sound, under control of the first controller 12. Reference numeral 13 represents a first memory which keeps information about a detail address of a building in which the radio transmitter 1 is mounted. One example of the detail address is "00ku, 00bunji, 00ho, 00building, 00floor". It is preferable that a telephone number of the building be also kept in the information in the first memory 13.

The information about the address of the building kept in the first memory 13 is used in generating transmission data by the first controller 12. The first controller 12 combines the information about the address and an identification code to generate the transmission data and emits an alerting audio sound, when the signal from the temperature sensor 11 generated upon detection of a fire is inputted to the first controller 12. If only one of the plurality of temperature sensors 11 mounted within several places of the building outputs the signal, the first controller 12 is adapted to start generating the transmission data.

On the other hand, a frequency generator 15 and a transmitter 16 are prepared to transmit the transmission data from the first controller 12 via an antenna, wherein the frequency generator 15 generates a frequency radio signal with a particular band range and mixes the frequency signal with the transmission data to make a transmission data having a particular frequency. The transmitter 16 amplifies the transmission data having a particular frequency up to a predetermined level and transmits the same through the antenna.

The radio receiver 2 is positioned in a fire fighting office, e.g., a fire station, and includes a receiver 23, a second controller 24, a display device 27 and a second memory 28.

The receiver 23 is provided with a filter 21 for filtering signals received by an antenna to detect desired data, an identifier 22 which reads the identification code contained in the data from the filter 21, compares the identification code with registered codes and outputs the results of the comparison to the second controller 24.

The display device 27 displays the address of the building suffering from the fire, the telephone number, etc., on a screen. The second memory 28 serves to keep the received data therein.

The second controller 24 controls all functions of the radio receiver 2 of the inventive fire alarm radio transmitter and receiver set. The second controller 24 allows the display device 27 to display the received data on its screen, saves the data in the second memory 28 for a future use and activates a notice alarm 25 for allowing the fireman to react to the fire, when the identification code contained in the received data agrees with the registered one, in the code identification by the receiver 23. Reference numeral 26 represents a control key part having a plurality of keys for controlling functions of the radio receiver 2.

Functions and effects of the inventive fire alarm radio transmitter and receiver set constructed in this manner are now described with reference to flow charts shown in FIGS. 2 and 3.

When the radio transmitter 1 is energized, the first controller 12 makes a self-test for checking if lines between the plurality of the temperature sensors 11 positioned on several places of the building are under a normal state or not. When fire breaks out in a building, the temperature sensor 11 detecting the fire outputs an electric signal; and the first controller 12 recognizes the fire occurrence from the signal from the temperature sensor 11 and activates the alarm 14 to inform people within the building of the fire occurrence. The first controller 12 combines the information about the address stored in the first memory 13 and the previously determined identification code to generate the transmission data and outputs the transmission data to the frequency generator 15 which mixes the frequency signal with the transmission data to make a transmission data having a particular frequency. The transmission data is amplified up to a predetermined level by the transmitter 16 to be transmitted ? through the antenna.

The transmission of the transmission data is repeated several times in order to allow the radio receiver 2 to receive the transmission data without fail.

On the other hand, the transmission data transmitted by the transmitter 16 is received by the antenna of the radio receiver 2 and then is sent to the filter 21 of the receiver 23 which filters the received data to detect data with a same frequency range as that in the frequency generator 15 of the radio transmitter 1.

The detected data signal from the filter 21 is inputted to the identifier 22; and an identifier 22 compares the identification code with registered codes and outputs the results of the comparison to the second controller 24. If the identification code agrees with the registered one, the second controller 24 allows the display device 27 to display the received data, i.e., the transmission data on its screen in order to show the address of the building and the telephone number, activating the notice alarm 25 for allowing the fireman to react to the fire and saving the data in the second memory 28 for a future use. If the identification code does not agree with the registered one, the second controller 24 disregards the received data.

The operator activates a release key which constitutes the control key part 26, the second controller 24 deactivates the notice alarm 25 to stay in a standby state, after the fireman react to the fire due to the reception of the transmission data, as described above.

As described above, the inventive fire alarm radio transmitter and receiver set includes the radio transmitter for automatically end promptly transmitting the alarm radio signal. The alarm radio signal contains information about the address of the building suffering from fire and the identification code. The radio receiver receives the alarm radio signal. The radio receiver displays the received data which includes the building address, and emits a fire alarm. When the received data, including the identification code is received, the radio receiver located in the fire station enables a quick extinguishment by fire fighting personnel, Although the invention has been shown and described with respect to the preferred embodiments, it will be understood by those skilled in the art that various changes and modifications may be made without departing from the spirit and scope of the invention as defined in the following claims.

What is claimed is:

1. A fire alarm radio transmitter and receiver set comprising:

a radio transmitter for installation to a fixed place having an address and a telephone number including:

a plurality of temperature sensors outputting an electric signal, when a temperature of the surroundings exceeds a predetermined level;

a first memory in which a series of location data including the address of the place on which the radio transmitter is installed and the telephone number of the place are stored;

a first controller for generating transmission data by combining the location data of the first memory and an identification code, and for causing an alarm to emit an alarm signal;

a frequency generator for generating a frequency radio signal with a particular band range, and for mixing the frequency radio signal with the transmission data, to make a transmission signal having a particular frequency; and a transmitter for amplifying the transmission signal having the particular frequency up to a predetermined level and for transmitting the same through a first antenna; and a radio receiver for installation in a fire station including a receiver which receives the transmission signal via a second antenna and filters the transmission signal to acquire desire data including the identification code and location data and compares the identification code with registered codes;

a display device for displaying the desired data on a screen;

a second memory in which the desired data is stored;

a control key part for activating various additional functions of the fire alarm radio transmitter and receiver set;

a notice alarm for emitting an alarm signal, when a predetermined signal is inputted thereinto; and a second controller which allows the display device to display the desired data on the screen and saves the desired data in the second memory and activates the notice alarm, when the identification code contained in the desired data agrees with one of the registered codes.

2. The fire alarm radio transmitter and receiver set of claim 1, wherein said temperature sensors are mounted in several positions within the place and the first controller is activated, if only one of the temperature sensors inputs an electric signal thereto.

3. A method for controlling a fire alarm radio transmitter and receiver set, said method comprising the steps of:

(a) checking if the radio transmitter and receiver set are under a normal state or not;

(b) emitting an alarm signal, when a fire is detected by temperature sensors;

(c) generating transmission data by combining location data, relating to an address of a building, and an identification code stored in a memory;

(d) generating a frequency radio signal with a particular band range and mixing the frequency radio signal with the transmission data to make a transmission signal having a particular frequency;

(e) transmitting the transmission signal through a first antenna;

(f) filtering the transmission signal to detect desired data including the identification code and the location data, after receiving the transmission signal via a second antenna;

(g) reading the identification code contained within the desired data and comparing the identification code with registered codes; and (h) allowing a display device to display the desired data on a screen, saving the desired data in a second memory and activating a notice alarm, when the identification code contained in the desired data agrees with one of the registered codes.

4. The method for controlling a fire alarm radio transmitter and receiver set of claim 3, wherein said transmitting step is repeated several times in order to raise a possibility of receiving the transmission signal.

* * * * *